US011078865B2

(12) United States Patent
Urzua Torres et al.

(10) Patent No.: US 11,078,865 B2
(45) Date of Patent: Aug. 3, 2021

(54) CYLINDER HEAD HOUSING, METHOD FOR PRODUCING A CYLINDER HEAD HOUSING, AND CASTING CORE

(71) Applicant: Volkswagen Aktiengesellschaft, Wolfsburg (DE)

(72) Inventors: Paulo Urzua Torres, Wolfsburg (DE); Michael Henn, Lehre (DE); Martin Bier, Meinersen (DE); Madlen Rudloff, Wolfsburg (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 0 days.

(21) Appl. No.: 16/664,320

(22) Filed: Oct. 25, 2019

(65) Prior Publication Data

US 2020/0056563 A1 Feb. 20, 2020

Related U.S. Application Data

(63) Continuation of application No. PCT/EP2018/059387, filed on Apr. 12, 2018.

(30) Foreign Application Priority Data

Apr. 28, 2017 (DE) ..... 10 2017 109 185.8

(51) Int. Cl.
*F02F 1/40* (2006.01)
*F02F 1/10* (2006.01)
(Continued)

(52) U.S. Cl.
CPC ..... *F02F 1/40* (2013.01); *F01P 3/02* (2013.01); *F02F 1/108* (2013.01); *F02F 1/38* (2013.01)

(58) Field of Classification Search
CPC ..... F02F 1/40; F02F 1/108; F02F 1/38; F02F 1/10; F02F 1/4285; F02F 1/36;
(Continued)

(56) References Cited

U.S. PATENT DOCUMENTS 6,928,964 B2 * 8/2005 Obermayer ..... F01P 3/16 123/41.82 R
8,939,116 B2 * 1/2015 Poschl ..... F01P 3/02 123/41.82 R
(Continued)

FOREIGN PATENT DOCUMENTS

CN 105822451 A 8/2016
DE 10 2005 050 510 A1 4/2007
(Continued)

*Primary Examiner* — Syed O Hasan
(74) *Attorney, Agent, or Firm* — Muncy, Geissler, Olds & Lowe, P.C.

(57) ABSTRACT

A cylinder head housing for a combustion unit, which forms at least two cylinders arranged in-line, having receiving openings for one outlet valve each, which are assigned to the individual cylinders of the combustion unit, comprising exhaust gas channels, which extend from these outlet valve receiving openings and are merged into an exhaust gas outlet channel, and cooling channels having a roof distribution channel which is connected to an injector cooling channel provided for an arrangement above a cylinder and/or having a manifold distribution channel, which extends along the row of outlet valve receiving openings, the manifold distribution channel being connected to a plurality of manifold network channels running along the exhaust gas channels, which are directly or indirectly connected to a manifold collection channel, which extends along the row of outlet valve receiving openings.

16 Claims, 7 Drawing Sheets

(51) Int. Cl.
*F02F 1/38* (2006.01)
*F01P 3/02* (2006.01)

(58) Field of Classification Search
CPC ..... F02F 2001/248; F01P 3/02; F01P 3/14; F01P 3/16
See application file for complete search history.

(56) References Cited

U.S. PATENT DOCUMENTS

| | | | | |
|---|---|---|---|---|
| 10,094,266 | B2 | 10/2018 | Poschl et al. | |
| 2007/0056535 | A1* | 3/2007 | Schlautman | F02F 7/007 123/41.74 |
| 2009/0000578 | A1* | 1/2009 | Reustle | B22D 19/0009 123/41.82 R |
| 2017/0067413 | A1* | 3/2017 | Maki | F02F 7/0085 |
| 2018/0003126 | A1 | 1/2018 | Tofukuji et al. | |
| 2018/0106213 | A1 | 4/2018 | Knollmayr | |

FOREIGN PATENT DOCUMENTS

| | | | | |
|---|---|---|---|---|
| DE | 10 2007 031 350 | A1 | 2/2009 | |
| DE | 10 2007 062 347 | A1 | 6/2009 | |
| DE | 102009019327 | * | 4/2010 | |
| DE | 10 2009 019 327 | A1 | 11/2010 | |
| DE | 102009019327 | A1 * | 11/2010 | F02F 1/40 |
| DE | 10 2010 036 392 | A1 | 3/2012 | |
| EP | 1972772 | A2 | 9/2008 | |
| EP | 3040547 | A1 | 7/2016 | |
| FR | 2682994 | A1 | 4/1993 | |
| JP | 2002-256966 | A | 9/2002 | |
| JP | 2003-035197 | A | 2/2003 | |
| JP | 2013-221459 | A | 10/2013 | |
| JP | 2014-084738 | A | 5/2014 | |
| WO | WO 2005/042955 | A2 | 5/2005 | |
| WO | WO-2016/113786 | A1 | 7/2016 | |
| WO | WO 2016/176710 | A1 | 11/2016 | |

* cited by examiner

CYLINDER HEAD HOUSING, METHOD FOR PRODUCING A CYLINDER HEAD HOUSING, AND CASTING CORE

This nonprovisional application is a continuation of International Application No. PCT/EP2018/059387, which was filed on Apr. 12, 2018, and which claims priority to German Patent Application No. 10 2017 109 185.8, which was filed in Germany on Apr. 28, 2017, and which are both herein incorporated by reference.

BACKGROUND OF THE INVENTION

Field of the Invention

The present invention relates to a cylinder head housing for a combustion unit, a method for manufacturing a cylinder head housing of this type, as well as a casting core for use in a method of this type. The invention also relates to a combustion unit comprising a cylinder head housing of this type as well as a motor vehicle comprising a combustion unit of this type.

Description of the Background Art

Internal combustion engines are usually cooled with the aid of a cooling fluid, which circulates in a cooling system of the internal combustion engine, transported by at least one coolant pump. The cooling system comprises cooling channels, which are formed by a cylinder block/housing as well as a cylinder head housing of a combustion unit of the internal combustion engine. Due to the circulating cooling fluid, thermal energy may be discharged from the combustion unit and also other components of the internal combustion engine to at least one ambient heat exchanger, in which the thermal energy is then transferred to the ambient air.

DE 10 2007 031 350 A1 discloses a multi-part cylinder head housing for a multi-cylinder combustion unit of an internal combustion engine, the cylinder head housing forming a receiving opening for a spark plug for each of the cylinders of the combustion unit as well as a total of four receiving openings for two inlet and outlet valves in each case. The cylinder head housing furthermore forms cooling channels, which are provided for a through-flow by means of a cooling fluid, the cooling channels comprising two distribution channels, which are arranged on both sides of the row of the receiving openings assigned to the individual cylinders and which extend in the longitudinal direction of the cylinder head housing. A cooling channel extends from each of these distribution channels, one of which is guided in an annular manner around the associated spark plug receiving opening. A cylinder head housing of this type is capable of improvement with regard to the cooling effect achievable with the aid of a through-flow of the cooling channels.

A cylinder head housing comprising integrated cooling channels is known from DE 10 2010 036 392 A1, the cooling channels forming a cooling jacket, which largely completely surrounds the receiving openings for spark plugs as well as gas exchange valves, which are assigned to individual cylinders of a combustion unit comprising the cylinder head housing. A comparable cylinder head housing is furthermore known from EP 1 972 772 A2. A cylinder head housing of this type may be characterized by a comparatively good cooling effect with the aid of a coolant flowing through the cooling jacket, but is complex in its manufacture and/or has a significantly impaired structural strength, due to the comparatively large volume of the cooling jacket.

SUMMARY OF THE INVENTION

It is therefore an object of the present invention to provide a cylinder head housing integrating a cooling channel for a combustion unit with regard to a preferably advantageous cooling effect and preferably compact dimensions.

According to an exemplary embodiment of the invention, a cylinder head housing, for example, designed as a single piece, for a (reciprocating) combustion unit is provided, the combustion unit forming at least two cylinders arranged in-line. The cylinder head housing comprises receiving openings for each of the cylinders, which are provided for receiving one outlet valve each, referred to below in short as an outlet valve receiving opening. Receiving openings for a fuel injector or a spark plug may also be provided in each case, which are assigned to the individual cylinders of the combustion unit. They are referred to below in short as injector receiving openings. The cylinder head housing furthermore comprises exhaust gas channels extending from the outlet valve openings (and integrated into the cylinder head housing), which are merged in an exhaust gas outlet channel, as well as (integrated) cooling channels, which are provided for a through-flow by means of a coolant. According to the invention, a cylinder head housing of this type is characterized in that the cooling channels comprise a roof distribution channel, which is fluid-conductively connected to a preferably annular injector cooling channel (which, in particular, surrounds an injector receiving opening in an annular manner in each case), provided for a (preferably central) arrangement above a cylinder, the injector cooling channels each being fluid-conductively connected to a plurality of roof network channels extending in different radial directions with respect to a longitudinal axis of the particular injector cooling channels (this longitudinal axis preferably corresponding to the longitudinal axis of the particular injector receiving opening and/or the associated cylinder of the combustion unit or running at least in parallel thereto), these roof network channels being fluid-conductively connected directly or indirectly to at least two roof collection channels, which are arranged on different sides with respect to the row defined by the injector cooling channels. The roof network channels may also preferably extend along the longitudinal axis of the particular injector cooling channel. Additionally or alternatively, it is provided according to the invention that the cooling channels comprise a manifold distribution channel, which extends along the row of outlet valve receiving openings, the manifold distribution channel being fluid-conductively connected to a plurality of manifold network channels running along (all) the exhaust gas channels and being directly or indirectly fluid-connectively connected to a manifold collection channel, which extends along the row of outlet valve receiving openings.

Accordingly, a cylinder head housing includes a relatively large number of relatively small-dimensioned cooling channels (in particular the roof and manifold network channels), whereby the (wall) surface which comes into contact with a coolant provided for flowing through the cooling channels may be significantly increased compared to conventional cylinder head housings. A correspondingly high heat transfer from the cylinder head housing to the coolant may be achieved thereby. This also makes it possible to allow an overall reduced volume flow of the coolant to circulate through the cooling channels without the cooling power being reduced thereby. A reduced volume flow of the coolant may thus result in a reduced transport power for a working machine provided to transport the coolant (a pump for the preferred use of a cooling fluid or a compressor for a likewise conceivable use of a cooling gas as the coolant), which may have a positive effect on both the costs and the weight of the working machine and thus of a combustion unit comprising a working machine of this type. This same applies to an internal combustion engine comprising a combustion unit of this type. If, as is usual, the working machine provided for transporting the coolant is driven directly by the combustion unit in the case of a combustion unit of this type or in the case of an internal combustion engine of this type, the reduced transport power achievable according to the invention may result in a reduction in the fuel consumption of the combustion unit. The relatively low volume flow of the coolant achievable according to the invention may also have a positive effect on the weight and also the dimensions of a cylinder head housing according to the invention. This holds true, not only due to a correspondingly reduced intrinsic weight of the coolant, which is relevant in particular with the preferred use of a cooling fluid, but also due to the improved structural strength/rigidity, compared to a conventional cylinder head housing whose cooling jacket is not divided according to the invention into a large number of relatively small-dimensioned cooling channels, this improved structural strength/rigidity setting in as a result of the overall smaller cooling channel volume as well as the stabilizing "partition walls" formed between the individual cooling channels.

A combustion unit according to the invention is characterized in that it comprises a cylinder head housing according to the invention. The cylinder head housing is part of a cylinder head of the combustion unit, corresponding function components (fuel injectors, spark plugs and outlet valves, as well as inlet valves and possibly one or multiple camshafts as well as other function components) being accommodated at least in the receiving openings formed by the cylinder head housing. Due to this design of a combustion unit according to the invention as a reciprocating combustion unit, the latter furthermore comprises at least one cylinder housing, including the cylinders formed therein and a piston movably arranged in each of the cylinders.

It may preferably be provided that a cylinder head housing according to the invention is integrated into a cooling system of a combustion unit according to the invention in such a way that a coolant flowing through the cooling system flows first through the roof distribution channel and only later through the roof collection channels. However, a reverse flow-through direction is also possible. The same applies to the through-flow of the manifold distribution channel compared to the manifold collection channel. It may be advantageous if the lower-lying cooling channels are flowed through before the higher-lying cooling channels, taking into account a provided operating orientation of a cylinder head according to the invention or a combustion unit comprising the latter, to improve a removal of gas bubbles in a cooling fluid used as the coolant.

To make optimal use of the advantages achievable by this design of a cylinder housing according to the invention, it should preferably be provided that the flow cross sections of the cooling channels are designed to be preferably small. In particular, it may be provided that the average flow cross section of (all) roof network channels (averaged over the longitudinal profiles thereof) is (in each case) smaller than, in particular less than half the size of, the average flow cross section of the roof distribution channel, the injector cooling channels and the roof collection channels. It may also be provided that the smallest flow cross section of (all) roof network channels is (in each case) smaller than the smallest flow cross section of the roof distribution channel, the injector cooling channels and the roof collection channels. With respect to the manifold network channels, it may be correspondingly provided that the average flow cross section of the manifold network channels (i.e. averaged over the longitudinal profiles thereof) is smaller than the average flow cross section of both the manifold distribution channel and the manifold collection channel, and/or the smallest flow cross section of the manifold network channels is smaller than the smallest flow cross section of both the manifold distribution channel and the manifold collection channel.

Too small a dimensioning of the flow cross sections of the cooling channels should, however, be avoided at the same time, because this may have a negative effect with respect to an increase in the flow resistance for the coolant, whereby at least the achievable advantage of a comparatively low transport power for the coolant could be compensated for or overcompensated for. It should therefore preferably be provided that the (smallest) flow cross section of the cooling channels and, in particular, that of the roof network channels and/or the manifold network channels is $\geq 1\ mm^2$. It may particularly preferably be between $2\ mm^2$ and $100\ mm^2$, in particular between $4\ mm^2$ and $25\ mm^2$.

A manufacture of a cylinder head housing according to the invention, however at least that of the section thereof encompassing the cooling channels, may advantageously take place with the aid of a generative manufacturing method or by casting, using an expendable (i.e. not a multiple-use) core forming at least the cooling channels, because these manufacturing methods advantageously permit the integration of cavities, which are fully closed, at least in sections, and are thus not accessible from the outside and are provided with relatively small dimensions, in a cylinder head housing to be manufactured.

In such a manufacture of a cylinder head housing according to the invention, or at least of the section thereof encompassing the cooling channels, with the aid of casting, using an expendable core, it may preferably be provided that a soluble and, in particular, water-soluble base material, for example a salt, may be used for the expendable core, because an essentially complete rinsing of the base material at least out of the cavities provided as cooling channels after the manufacture of the cylinder head housing is advantageously and relatively easily made possible thereby. This applies, in particular, compared to an insoluble base material, such as sand, which is regularly used for a casting of metal structures and which may be rinsed out but does not dissolve in the rinsing liquid.

A casting core according to the invention, which is provided for use in a method according to the invention for manufacturing a cylinder housing according to the invention, comprises casting core sections, which are designed as a negative mold of the cooling channels of a cylinder housing according to the invention. A manufacture of a casting core of this type according to the invention may advantageously take place with the aid of casting, a use of a sand mold being able to be advantageously provided for this purpose. This holds true, in particular, if a use of a soluble base material, and in particular a salt as the base material, is provided for the formation of the casting core.

To stabilize a casting core according to the invention, which may be characterized by a relatively large number of casting core sections, which are relatively small in cross section and simultaneously are dimensioned to be long, and which may thus be characterized by a relatively sensitive structure, structural measures may be provided. For example, a support structure, e.g. made from metal wires, may be integrated into the casting core, these support structures being able to remain in, i.e. integrated into, a cylinder head housing formed using a casting core of this type, A cylinder head housing according to the invention may be optimized with respect to the achievement of a preferably advantageous cooling effect, which is achieved, in particular, by a preferably advantageous arrangement or a preferably advantageous profile of the cooling channels, with the aid of different measures.

For this purpose, it may be provided, in particular, that the roof network channels extending out of the individual injector cooling channels transition into one or multiple roof ring channels, which at least partially encircle the longitudinal axis of the particular injector cooling channel and which open into the roof collection channels. In particular, a preferably advantageous cooling for the combustion chamber roofs of a combustion unit according to the invention, which are delimited by the cylinder head housing, may be achieved thereby.

It may also be provided that the manifold network channels are at least partially fluid-conductively connected to one or multiple manifold ring channels, which at least partially and preferably completely encircle one or multiple, preferably all, of the exhaust gas channels and which, in turn, are fluid-conductively connected to the manifold collection channel. The manifold ring channels may be disposed, in particular, preferably close to the transitions between the cylinders and the exhaust gas channels and consequently in the vicinity of valve seats provided for the outlet valves, whereby, in particular, an advantageous cooling may be implemented for these valve seats and thus the outlet valves interacting therewith.

It may furthermore be provided that the manifold distribution channel and the manifold collection channel are disposed on different sides with respect to a row formed by the exhaust gas channels. In particular, a preferably advantageous cooling for the section of a cylinder head housing integrating the exhaust gas channels may be implemented hereby.

It may also be advantageously provided that a longitudinally axial end of the roof distribution channel transitions into a roof inflow or outflow channel, and/or a longitudinally axial end of each roof collection channel transitions into a roof outflow or inflow channel. An advantageous position of the roof inflow channel(s) and/or the roof outflow channel(s), which may serve as the connection between the remaining (roof) cooling channels of the cylinder head housing and other cooling channels and/or coolant lines of a combustion unit according to the invention or an internal combustion engine according to the invention, may be achieved thereby.

The same purpose may be served if, as preferably provided, a manifold inflow channel transitions into the manifold distribution channel in a section of the manifold distribution channel abutting the exhaust gas outlet channel, and/or a manifold outflow channel extends out of the manifold collection channel in a section of the manifold collection channel abutting the exhaust gas outlet channel. If such an integration into the cylinder head housing is provided for both a manifold inflow channel and for a manifold outflow channel, it may be furthermore preferably provided that these channels are disposed on different sides with respect to the exhaust gas outlet channel and, in particular, in a radially opposite manner (with respect to a longitudinal axis of the exhaust gas outlet channel).

A further improvement of a cylinder head housing according to the invention is implemented with respect the cooling effect achievable therefor with the aid of an exhaust gas outlet cooling channel, which (directly) connects the manifold distribution channel and the manifold collection channel and preferably completely encircles the exhaust gas outlet channel.

It may also be provided that the roof distribution channel and/or the roof collection channels and/or the manifold distribution channel and/or the manifold collection channel is/are (each) guided along the entire row of exhaust gas channels/receiving openings, which, in turn, may have an advantageous effect with respect to the achievement of a preferably optimal cooling effect for the cylinder head housing or for the cylinder head of a combustion unit according to the invention.

The invention also relates to a motor vehicle, in particular a wheel-based motor vehicle (preferably a passenger car or truck), which comprises a combustion unit according to the invention. The combustion unit may be provided, in particular, for the (direct or indirect) provision of the driving power for the motor vehicle.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
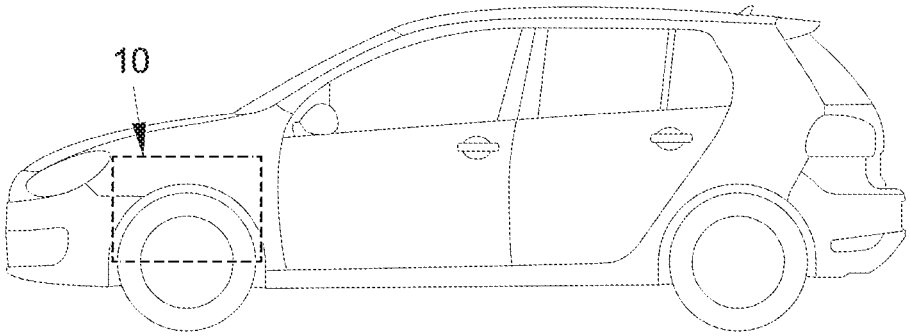
FIG. 1 shows a motor vehicle according to the invention.
Figure 2:
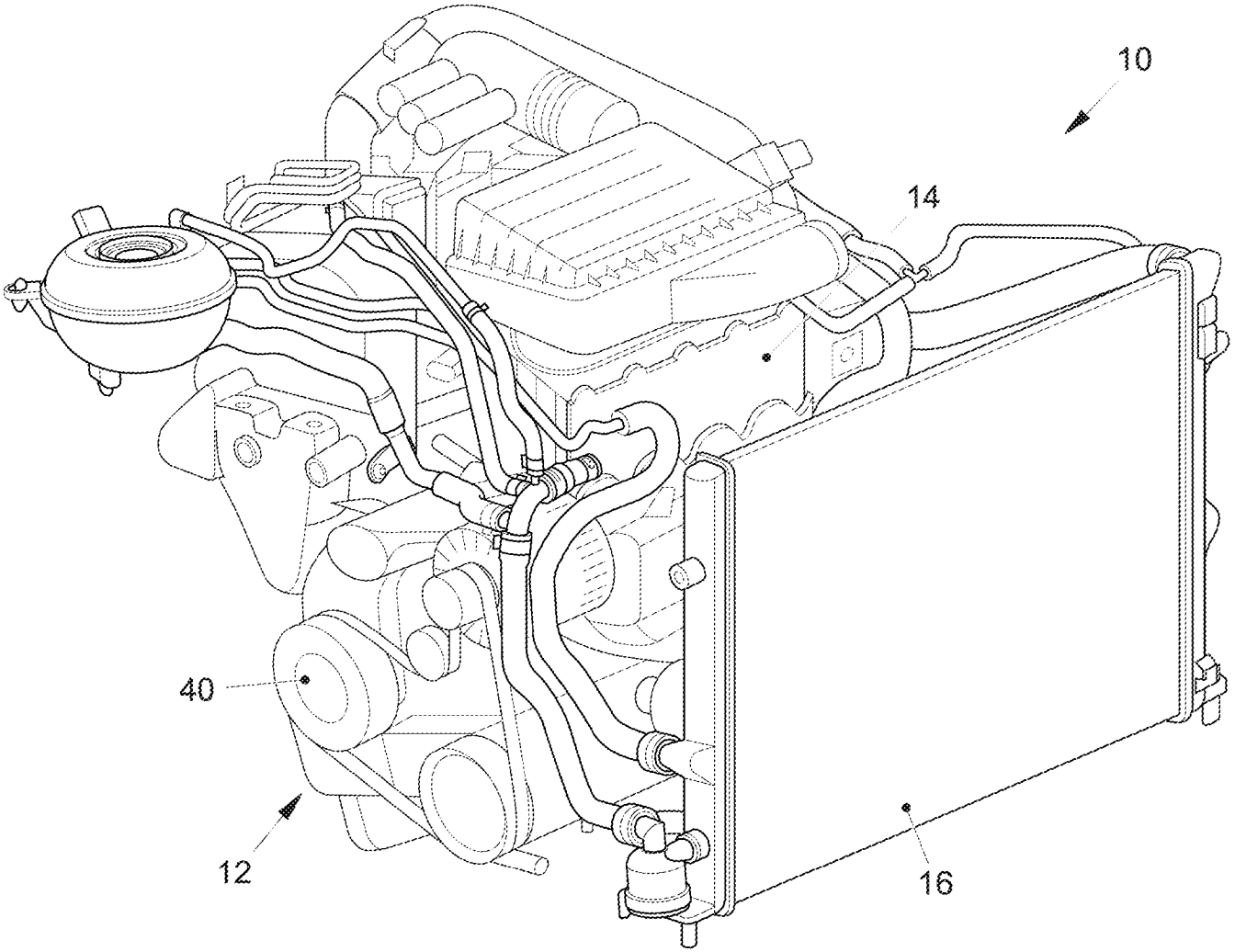
FIG. 2 shows a internal combustion engine according to the invention.
Figure 3:
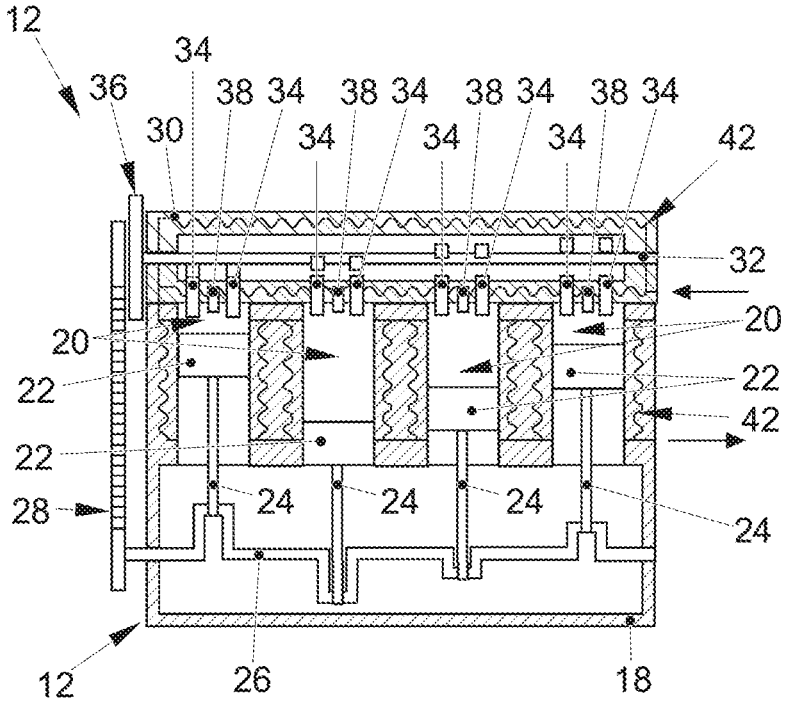
FIG. 3 shows a simplified representation of the combustion unit of the internal combustion engine according to FIG. 2.

FIG. 1 shows a motor vehicle according to the invention, comprising an internal combustion engine 10, which is illustrated in detail in FIGS. 2 and 3.

Internal combustion engine 10 comprises a combustion unit 12, which is charged with the aid of a compressor and, during operation, may provide the driving power for the driving operation of the motor vehicle. The compressor is part of an exhaust gas turbocharger. In the present exemplary embodiment according to FIG. 3, combustion unit 12 is designed as a four-cylinder (in-line) reciprocating engine and may be operated, for example, according to the gasoline or diesel principle. For this purpose, cylinders 20 are formed in an engine block 18, in which pistons 22 are longitudinally axially movably arranged. A movement of pistons 22 induced by the combustion process is transmitted via connecting rods 24 to a crankshaft 26 rotatably mounted in engine block 18. This rotation of crankshaft 26 may be transmitted to driven wheels of a motor vehicle according to FIG. 1. Combustion unit 12, or internal combustion engine 10 comprising it, may thus be used to generate driving power for the motor vehicle.

A rotation of crankshaft 26 is also transmitted to a rotatably mounted first camshaft 32 in a cylinder head housing 30 of combustion unit 12 with the aid of a timing assembly 28, for example in the form of a toothed belt or chain drive. A rotational movement of first camshaft 32 is transmitted to a second camshaft, for example with the aid of a toothed wheel drive 36 (with a gear ratio of one). The second camshaft may be an intake camshaft of combustion unit 12, with the aid of which inlet valves (two per cylinder 20 in each case) may be actuated, via which fresh gas may be introduced in a controlled manner into combustion chambers, which are delimited by cylinders 20, pistons 22 and cylinder head housing 30. This fresh gas is combusted with fuel injected directly into the combustion chambers to effectuate the movement of pistons 22 induced by the rotation of crankshaft 26 within cylinders 20. In contrast, first camshaft 32 may be an outlet camshaft, with the aid of which outlet valves (34) (two per cylinder 20 in each case) are actuated, via which exhaust gas, which was generated upon a combustion of fuel/fresh gas mixtures in the combustion chambers, may be discharged in a controlled manner.

Fuel from a fuel tank of internal combustion engine 10 is supplied to fuel injectors 38 of combustion unit 12 with the aid of a fuel pump. The fuel is introduced into the combustion chambers in a metered manner under relatively high pressure and at predetermined points in time with the aid of fuel injectors 38. In an embodiment of combustion unit 12 as a diesel engine, fuel injectors 38 assigned to the individual combustion chambers may be arranged approximately centrally between the associated gas exchange valves in each case (inlet valves and outlet valves 34). In an embodiment of combustion unit 12 as a gasoline engine, on the other hand, it may be provided that a spark plug is disposed at this location. In this case, and in a direct-injection embodiment of the gasoline engine, an alternative arrangement with respect to the combustion chambers may then be selected for an integration of fuel injectors. Cylinder head housing 30 has receiving openings for accommodating fuel injectors 38 and/or the spark plugs as well as for accommodating the gas exchange valves.

Internal combustion engine 10 furthermore comprises a cooling system having at least two cooling circuits, the cooling system being used to cool individual components of internal combustion engine 10, among other things combustion unit 12, an engine oil cooler and a charge air cooler 14 and possibly also other components of the motor vehicle integrating internal combustion engine 10, e.g. a transmission oil cooler. A cooling fluid, which absorbs the thermal energy from the components to be cooled, circulates in the cooling system as a result of an operation of the fuel pump. This thermal energy is then cooled again in a main cooler 16 as well as possibly temporarily in a heater heat exchanger by a heat transfer to ambient air, so that it may be recirculated back to the components to be cooled. A heat transfer from the cooling fluid to the ambient air takes place in main cooler 16 exclusively with the goal of cooling the cooling fluid. A heat transfer within the heater heat exchanger, however, would take place primarily with the goal of controlling the temperature of ambient air, which is to be subsequently supplied to an interior of the motor vehicle.

To cool combustion unit 12, both engine block 18 and cylinder head housing 30 each form a cooling channel system 42, through which the cooling fluid may be conducted. These two cooling channel systems 42 may be connected in series according to FIG. 3, so that the cooling fluid transported by a coolant pump 40 (cf. FIG. 2) of the internal combustion engine first flows through cooling channel system 42 of cylinder head housing 30 before it flows over cooling channel system 42 of engine block 18.

Figure 4:
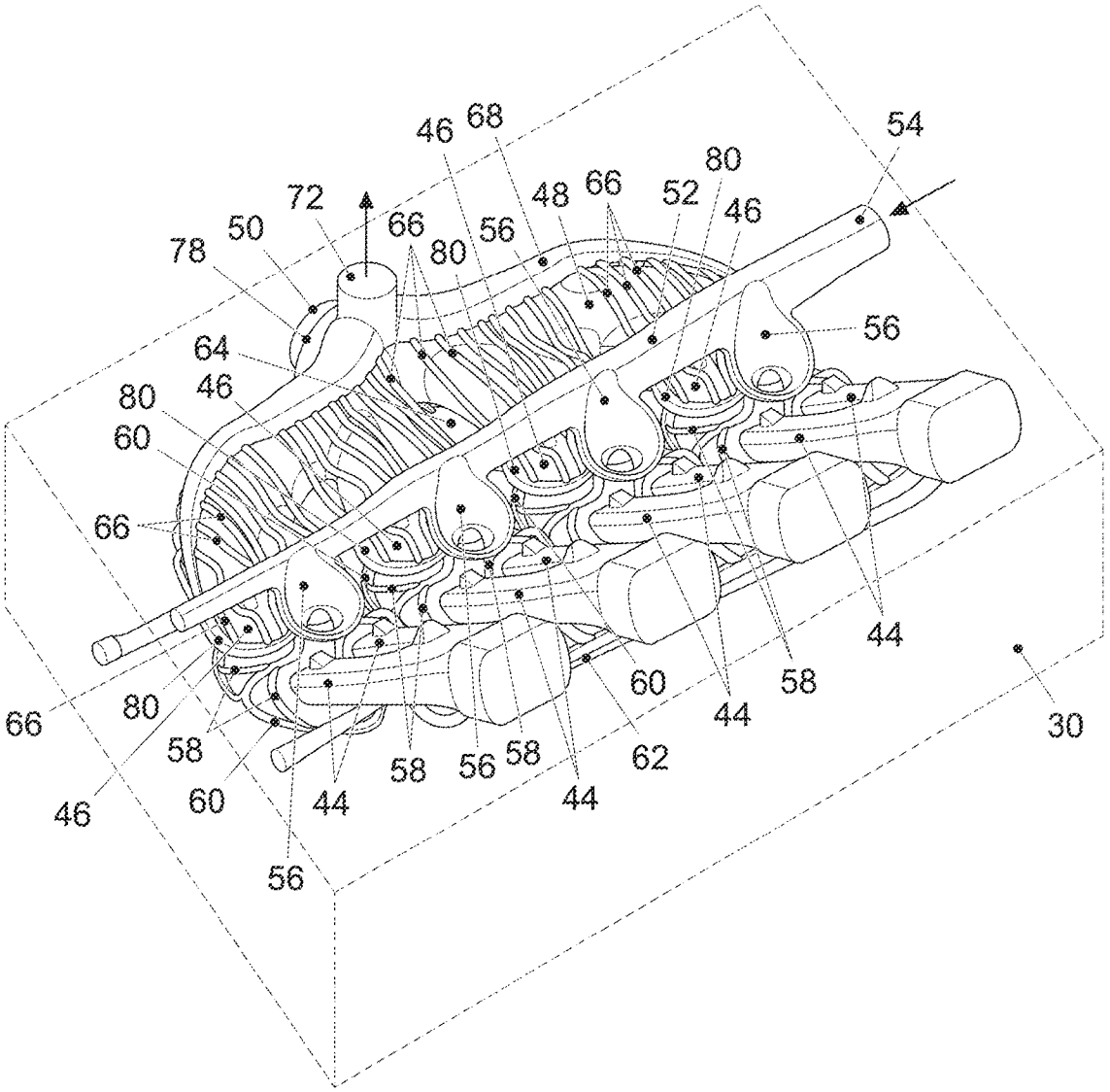
FIG. 4 shows a first view of a cylinder head housing according to the invention, for example for a combustion unit according to FIG. 3.
Figure 5:
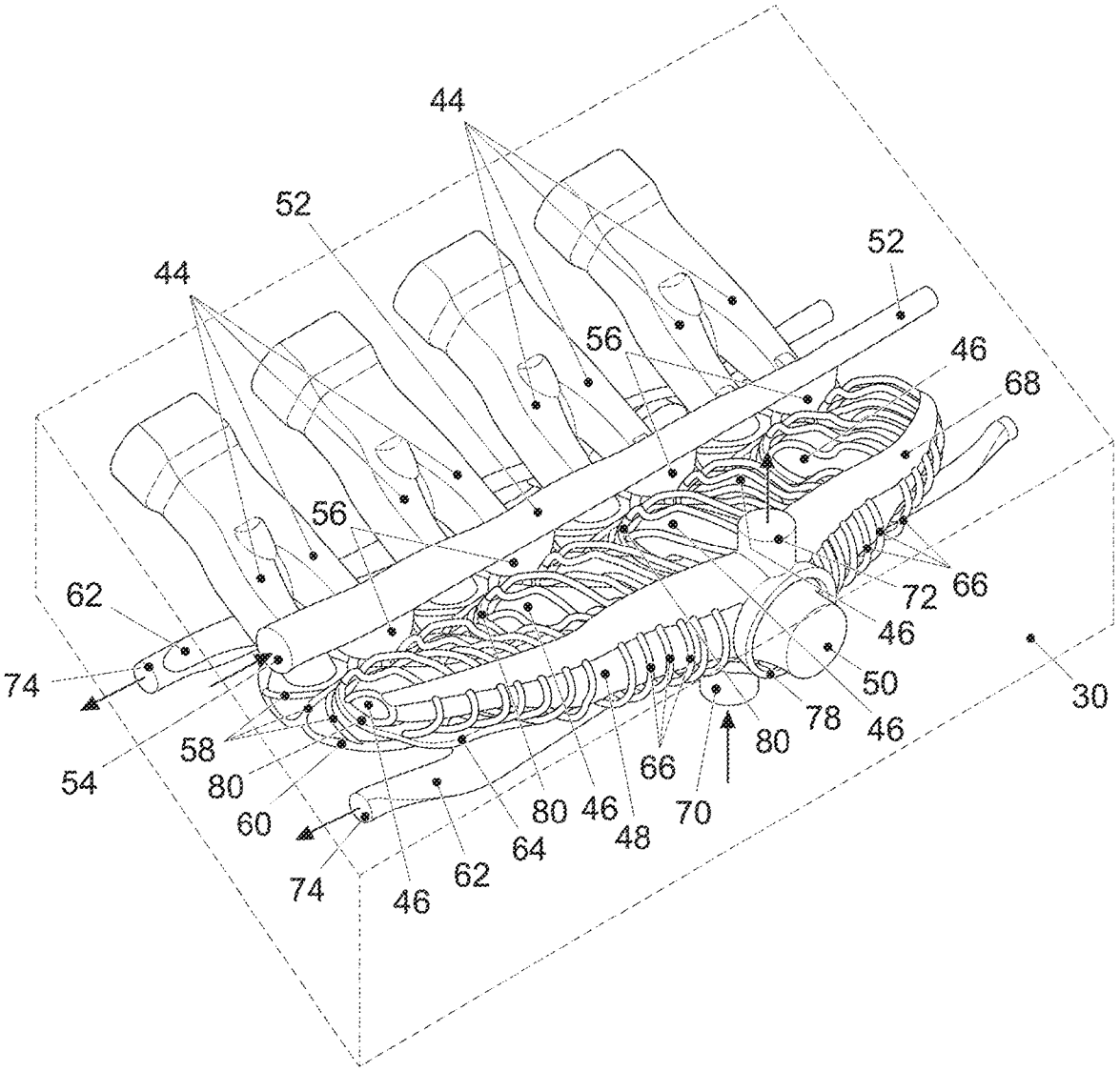
FIG. 5 shows a second view of the cylinder head housing according to FIG. 4.

The specific embodiment of cooling channel system 42 formed in a cylinder head housing 30 (according to the invention) of a combustion unit 12 according to FIGS. 2 and 3 is illustrated in FIGS. 4 and 5. Cylinder head housing 30 itself is illustrated only in a greatly simplified manner in each case, while the cavities relevant for understanding the invention, which are formed by cylinder head housing 30, are illustrated in detail.

Accordingly, for each of the combustion chambers or cylinders 20 of engine block 18, cylinder head housing 30 forms two fresh gas channels 44, whose openings into the combustion chambers may each be closed or released as needed with the aid of an inlet valve, the two fresh gas channels 44 assigned to one combustion chamber in each case being integrally designed in an initial section, i.e. as a single channel. These integrally formed initial sections directly abut an intake manifold, which represents a section of a fresh gas system of the internal combustion engine.

Cylinder head housing 30 furthermore forms two exhaust gas channels 46 for each of the combustion chambers, the transitions of exhaust gas channels 46 into the combustion chambers each being able to be closed or released as needed with the aid of an outlet valve 34. Exhaust gas channels 46, which are guided separately in a first section, transition into a collection section 48 running approximately in the longitudinal direction of cylinder head housing 30, from which an exhaust gas outlet channel 50 extends approximately in the middle with respect to the longitudinal direction of cylinder head housing 30.

Cooling channel system 42 of cylinder head housing 30 comprises a roof distribution channel 52, which is disposed above the combustion chambers and runs in the longitudinal direction of cylinder head housing 30, offset approximately from the center. A (longitudinally axial) end of roof distribution channel 52 transitions into a roof inflow channel 54, via which the cooling fluid may be supplied to roof distribution channel 52. The other (longitudinally axial) end of roof distribution channel 52, on the other hand, is designed to be closed, or it ends as a "dead end" within cylinder head housing 30.

Four injector cooling channels 56 extend from roof distribution channel 52, each of which annularly surrounds one of the injector receiving openings, i.e. a receiving opening, in which either a fuel injector 38 or a spark plug is disposed.

Extending out of each of injector channels 56 is a plurality of roof network channels 58, which extend in different radial directions with respect to the longitudinal axes of the injector receiving openings and also along these longitudinal axes (in the direction of an increasing approach to the combustion chambers) and which are provided with comparatively small dimensions with respect to their flow cross sections, and which transition into a roof ring channel 60, which completely encircles the particular injector receiving opening in an annual manner in each case, i.e. for all of the roof network channels 58 extending from one of injector cooling channels 56.

The four roof ring channels 60, in turn, transition into three roof collection channels 62, two of which are disposed on one side and the third on the other side with respect to the row defined by the injector receiving openings, and which also extend along the longitudinal direction of cylinder head housing 30 and thus approximately in parallel to roof distribution channel 52. The cooling fluid situated therein may be discharged via one of the (longitudinally axial) ends of roof collection channels 62 in each case, each of which transitions into a roof outflow channel 74. The two roof collection channels 62 disposed on the same side with respect to the row defined by the injector receiving openings transition into a common roof outflow channel 74. The longitudinally axial ends of roof collection channels 62 which do not transition into a roof outflow channel 74, in turn, end in cylinder head housing 30.

Figure 7:
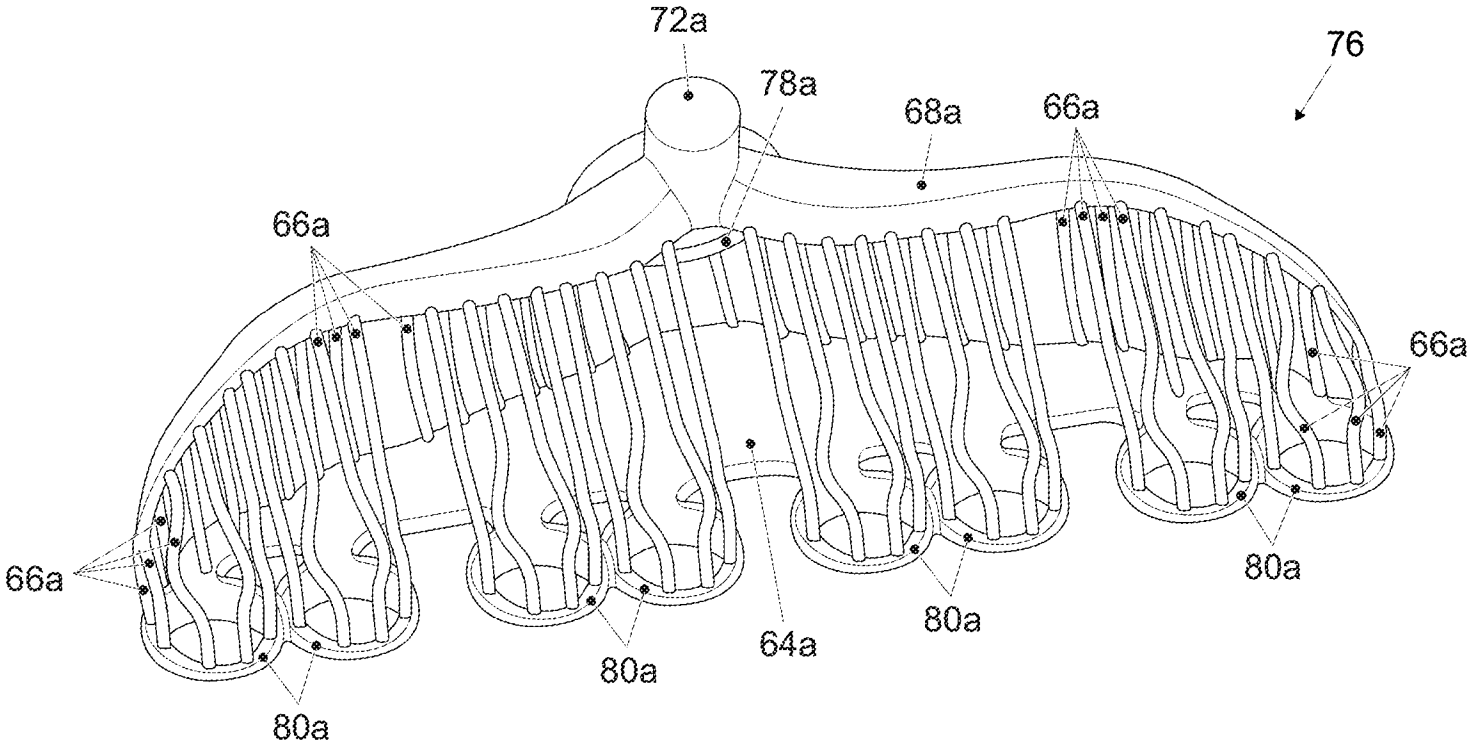
FIG. 7 shows a casting core provided for forming manifold cooling channels of the cylinder head housing according to FIGS. 5 and 6.

Cooling channel system 42 of cylinder head housing 30 furthermore comprises a manifold distribution channel 64 formed over a relatively wide area, which extends along the row of outlet valve receiving openings and therefore primarily in the longitudinal direction of cylinder head housing 30, a manifold ring channel 80 extending out of manifold distribution channel 64 for each separate exhaust gas channel 46, manifold ring channels 80 being arranged preferably close to the proximal ends of exhaust gas channels 46 with respect to cylinders 20 and fully encircling particular exhaust gas channels 46 (cf. FIG. 7). Manifold ring channels 80 of the two exhaust gas channels 46 assigned to a cylinder 20 in each case transition into each other in the area of one circumferential section. Extending from each of manifold ring channels 80 is a plurality of manifold network channels 66, which run along separately guided exhaust gas channels 46 and which are also provided with comparatively small dimensions and transition directly into a manifold collection channel 68, which also extends along the row of outlet valve receiving openings and consequently primarily in the longitudinal direction of cylinder head housing 30. Additional manifold network channels 66 are also provided, which, having a bow-shaped profile, directly connect manifold distribution channel 64 to manifold collection channel 68 and partially encircle collection section 48 of exhaust gas channels 46 on the side of collection section 48 facing away from the outlet valve receiving openings.

A manifold inflow channel 70 opens into manifold distribution channel 64 approximately in the middle and thus in a section abutting exhaust gas outlet channel 50. Cooling fluid may be supplied to manifold distribution channel 64 via manifold inflow channel 70. This cooling fluid is then distributed within manifold distribution channel 64 and subsequently flows into the large number of manifold network channels 66. Cooling fluid which has flowed through manifold network channels 66 collects in manifold collection channel 68 and may be discharged therefrom via a manifold outflow channel 72 extending out of manifold collection channel 68 approximately in the middle and thus in a section abutting exhaust gas outlet channel 50.

Cooling channel system 42 of cylinder head housing 30 furthermore comprises an annular exhaust gas outlet cooling channel 78, which connects manifold distribution channel 64 and manifold collection channel 68 to each other in the area of manifold inflow channel 70 and manifold outflow channel 72 and encircles exhaust gas outlet channel 50 in an annular manner.

The embodiment of roof cooling channels (52, 54, 56, 58, 60, 62 and 74), on the one hand, and manifold cooling channels (64, 66, 68, 70, 72, 78 and 80), on the other hand, each having one inflow channel (54; 70) and at least one outflow channel (74; 72), makes it possible to integrate them in parallel into a cooling circuit of a cooling system of an internal combustion engine, for example, according to FIG. 2, so that cooling fluid, which flows through this cooling circuit in a circulation cycle is conducted through either roof cooling channels (52, 54, 56, 58, 60, 62 and 74) or manifold cooling channels (64, 66, 68, 70, 72, 78 and 80). Alternatively, however, it is possible to integrate roof cooling channels (52, 54, 56, 58, 60, 62 and 74) and manifold cooling channels (64, 66, 68, 70, 72, 78 and 80) in series into the cooling circuit, so that the cooling fluid first flows through roof cooling channels (52, 54, 56, 58, 60, 62 and 74) or manifold cooling channels (64, 66, 68, 70, 72, 78 and 80) and is only subsequently conducted through each of the other cooling channels (52 through 74, 78, 80).

Figure 6:
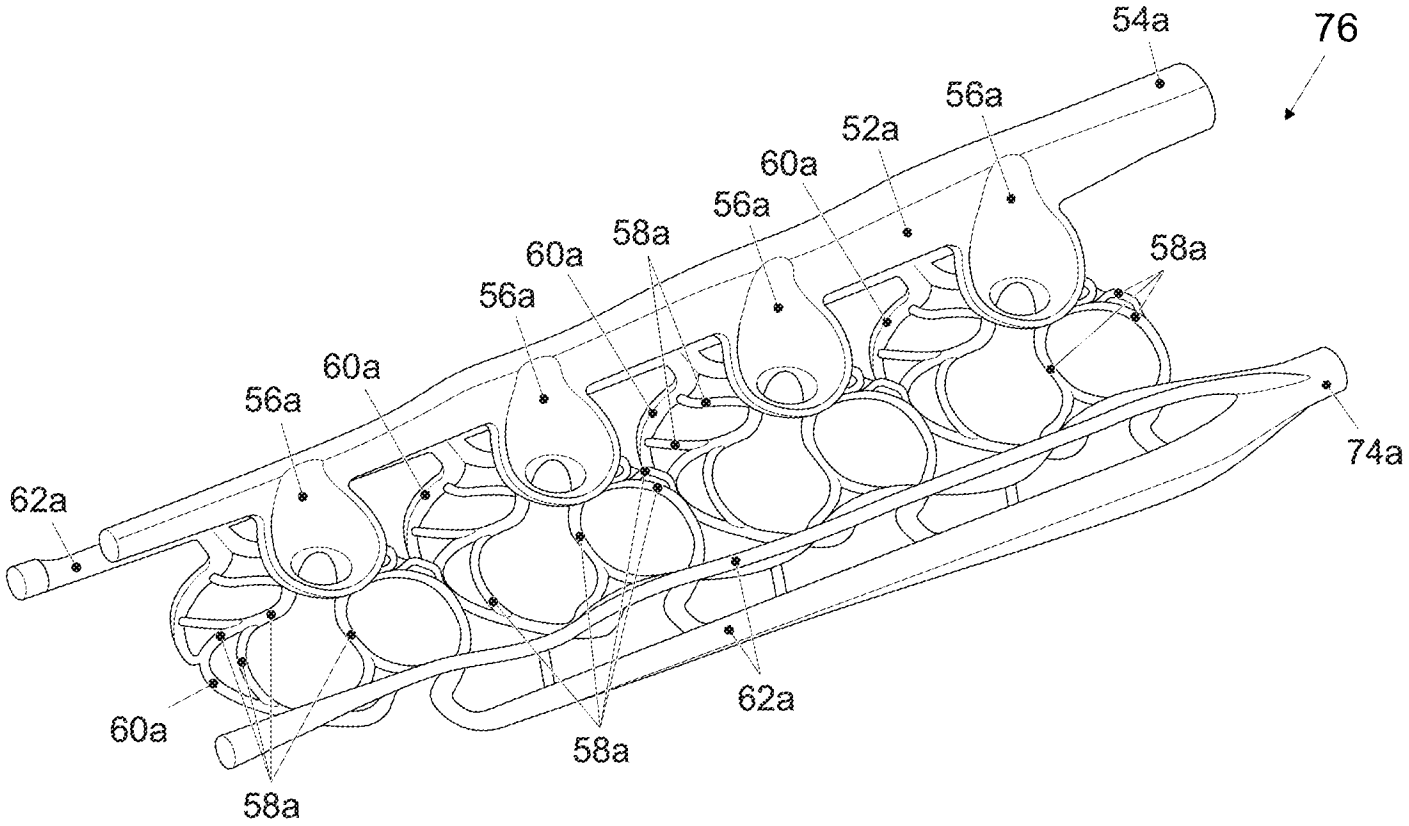
FIG. 6 shows a casting core provided for forming roof cooling channels of the cylinder head housing according to FIGS. 4 and 5.

FIGS. 6 and 7 show two casting cores 76, which may be manufactured, for example, from a lightweight metal alloy by means of casting in a method for manufacturing a cylinder head housing 30 according to FIGS. 4 and 5. Two separate casting cores 76 are illustrated, which, however, may also be connected to each other or formed as a single piece.

In particular, the casting cores may also be connected to or formed as a single piece with other casting cores, which are used to form the remaining opening and cavities (in particular the injector receiving openings, outlet valve receiving openings, etc.). In FIGS. 6 and 7, the casting core sections which result in the formation of the individual cooling channels (52 through 74, 78, 80) during the manufacture of a corresponding cylinder head housing 30 are marked by the same reference numerals which are also used for these cooling channels (52 through 74, 78, 80), however with the addition of the letter a in each case.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A cylinder head housing for a combustion unit, which forms at least two cylinders arranged in-line, comprising:

receiving openings for one outlet valve each, which are assigned to the individual cylinders of the combustion unit;

exhaust gas channels that extend from the outlet valve receiving openings and are merged into an exhaust gas outlet channel; and a roof distribution channel for delivering coolant that is connected to injector cooling channels arranged above each of the at least two cylinders, the injector cooling channels being connected to roof network channels which extend in different radial directions with respect to a longitudinal axis of the particular injector cooling channel and which are directly or indirectly connected to at least two roof collection channels, the at least two roof collection channels being arranged on different sides with respect to a row defined by the injector cooling channels, the roof distribution channel and the at least two roof collection channels extending across the at least two cylinders; and/or a manifold distribution channel, which extends along parallel to the row of outlet valve receiving openings, the manifold distribution channel being directly or indirectly connected to a plurality of manifold network channels running along the exhaust gas channels, which are directly or indirectly connected to a manifold collection channel, which extends along parallel to the row of outlet valve receiving openings.

2. The cylinder head housing according to claim 1, further comprising receiving openings for one fuel injector or one spark plug each, which are assigned to the individual cylinders of the combustion unit, the injector cooling channels annularly surrounding the injector receiving openings.

3. The cylinder head housing according to claim 1, wherein the average flow cross section of the roof network channels is smaller than the average flow cross section of the roof distribution channel, the injector cooling channels and the roof collection channels, and/or the smallest flow cross section of the roof network channels is smaller than the smallest flow cross section of the roof distribution channel, the injector cooling channels and the roof collection channels; and/or wherein the average flow cross section of the manifold network channels is smaller than the average flow cross section of both the manifold distribution channel and the manifold collection channel, and/or the smallest flow cross section of the manifold network channels is smaller than the smallest flow cross section of both the manifold distribution channel and the manifold collection channel.

4. The cylinder head housing according to claim 1, wherein the roof network channels extending out of the individual injector cooling channels transition into one or multiple roof ring channels, which at least partially encircle the longitudinal axis of the particular injector cooling channel and which open into the roof collection channels.

5. The cylinder head housing according to claim 1, wherein the manifold network channels are at least partially connected to one or multiple manifold ring channels, which at least partially encircle one or multiple of the exhaust gas channels and which are connected to the manifold distribution channel.

6. The cylinder head housing according to claim 1, wherein the manifold distribution channel and the manifold collection channel are disposed on different sides with respect to a row formed by the exhaust gas channels.

7. The cylinder head housing according to claim 1, wherein a longitudinally axial end of the roof distribution channel transitions into a roof inflow channel or roof outflow channel, and/or a longitudinally axial end of the roof collection channels each transition into a roof outflow channel or roof inflow channel.

8. The cylinder head housing according to claim 1, wherein a manifold inflow channel transitions into the manifold distribution channel in a section of the manifold distribution channel abutting the exhaust gas outlet channel, and/or a manifold outflow channel extends out of the manifold collection channel.

9. The cylinder head housing according to claim 1, further comprising an exhaust gas outlet cooling channel, which connects the manifold distribution channel and the manifold collection channel and which encircles the exhaust gas outlet channel.

10. The cylinder head housing according to claim 1, wherein the roof distribution channel and/or the roof collection channels and/or the manifold distribution channel and/or the manifold collection channel is/are guided along the entire row of exhaust gas channels.

11. A method for manufacturing a cylinder head housing according to claim 1, characterized by the formation via a generative manufacturing method or by casting, using an expendable casting core which forms at least the cooling channels.

12. The method according to claim 11, wherein a soluble base material forms the casting core.

13. A casting core for the method according to claim 11, comprising casting core sections, which are configured as a negative mold of the cooling channels of a cylinder housing.

14. The cylinder head housing according to claim 1, wherein the manifold network channels are physical channels that extend toward cylinder heads of the at least two cylinders and extend substantially perpendicularly from the manifold distribution channel.

15. The cylinder head housing according to claim 1, wherein the roof network channels transition into a roof ring channel that encircles a particular injector receiving opening at each of the at least two cylinders.

16. A cylinder head housing for a combustion unit, which forms at least two cylinders arranged in-line, comprising:

receiving openings for one outlet valve each, which are assigned to the individual cylinders of the combustion unit;

exhaust gas channels that extend from the outlet valve receiving openings and are merged into an exhaust gas outlet channel;

a roof distribution channel connected to at least two injector cooling channels, each of the at least two injector cooling channels being arranged above one of the at least two cylinders, the injector cooling channels being connected to roof network channels which extend in different radial directions with respect to a longitudinal axis of the particular injector cooling channel and which are directly or indirectly connected to at least two roof collection channels, the at least two roof collection channels being arranged on different sides with respect to the row defined by the injector cooling channels;

receiving openings for one fuel injector or one spark plug each, which are assigned to the individual cylinders of the combustion unit, the injector cooling channels annularly surrounding the injector receiving openings; and a manifold distribution channel, which extends along the row of outlet valve receiving openings, the manifold distribution channel being directly or indirectly connected to a plurality of manifold network channels running along the exhaust gas channels, which are directly or indirectly connected to a manifold collection channel, which extends along the row of outlet valve receiving openings.

* * * * *